US009819072B2

(12) United States Patent
Wu et al.

(10) Patent No.: US 9,819,072 B2
(45) Date of Patent: Nov. 14, 2017

(54) WIRELESS COMMUNICATION APPARATUS AND ANTENNA MODULE THEREOF

(71) Applicant: PEGATRON CORPORATION, Taipei (TW)

(72) Inventors: Chien-Yi Wu, Taipei (TW); Chao-Hsu Wu, Taipei (TW); Cheng-Hsiung Wu, Taipei (TW); Chun-Yen Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 31 days.

(21) Appl. No.: 15/182,617

(22) Filed: Jun. 15, 2016

(65) Prior Publication Data

US 2016/0380336 A1 Dec. 29, 2016

(30) Foreign Application Priority Data

Jun. 26, 2015 (TW) ..... 104120770 A

(51) Int. Cl.

| | |
|---|---|
| ***H01Q 1/24*** | (2006.01) |
| ***H01Q 1/48*** | (2006.01) |
| ***H01Q 1/50*** | (2006.01) |
| ***H01Q 5/371*** | (2015.01) |

(52) U.S. Cl.

CPC ..... *H01Q 1/243* (2013.01); *H01Q 1/48* (2013.01); *H01Q 1/50* (2013.01); *H01Q 5/371* (2015.01)

(58) Field of Classification Search

CPC ..... H01Q 1/243; H01Q 5/371; H01Q 1/48; H01Q 1/50

See application file for complete search history.

(56) References Cited

U.S. PATENT DOCUMENTS

2015/0171518 A1* 6/2015 Lee ..... H01Q 5/378 343/843

FOREIGN PATENT DOCUMENTS

| | | |
|---|---|---|
| TW | 201010176 A | 3/2010 |
| TW | I469438 B | 1/2015 |

* cited by examiner

*Primary Examiner* — Hoang Nguyen

(74) *Attorney, Agent, or Firm* — CKC & Partners Co., Ltd.

(57) ABSTRACT

A wireless communication apparatus includes a substrate, an electrical insulation cover, a first antenna and a second antenna. The substrate has a ground surface. The electrical insulation cover covers the substrate. The electrical insulation cover has first and second surfaces. The first antenna is disposed on the first surface and is electrically connected to the ground surface. The second antenna is disposed on the second surface and includes first and second capacitive coupling portions, a signal feeding portion and a first slit. The signal feeding portion connects the first and second capacitive coupling portions. The first slit is located between the first and second capacitive coupling portions. The first antenna can generate first and second resonant modes with the first and second capacitive coupling portions in a manner of capacitive coupling, respectively. The first and second resonant modes have different frequency bands.

14 Claims, 4 Drawing Sheets

WIRELESS COMMUNICATION APPARATUS AND ANTENNA MODULE THEREOF

RELATED APPLICATIONS

This application claims priority to Taiwan Application Serial Number 104120770, filed Jun. 26, 2015, which is herein incorporated by reference.

BACKGROUND

Technical Field

The present disclosure relates to a communication apparatus. More particularly, the present disclosure relates to a wireless communication apparatus and an antenna module thereof.

Description of Related Art

In pace with development of the wireless communication technique, various electronic products having the wireless communication ability, such as a mobile phone, a tablet computer and so on, widely employ the wireless communication technique to transfer information. In the wireless communication technique, long term evolution (LTE) is a wireless broadband technique that draws attention.

Since a typical printed inverted-F antenna has a poor low frequency bandwidth that cannot sufficiently cover the LTE-700 frequency band, a switch is designed for switch the resonant path of the antenna, such that the antenna can be switched to provide different low frequency resonant modes corresponding to the LTE 700 frequency band, so as to cover the LTE-700 frequency band.

However, in the LTE carrier aggregation (LTE-CA) requirements, the antenna is required to transreceive signals in the ranges of different frequency bands, the antenna is therefore not satisfactory for the LTE-CA requirements because the antenna requires the switch to switch the resonant mode to cover the particular frequency band.

SUMMARY

The present disclosure provides a wireless communication apparatus and an antenna module thereof, in which the antenna module can generate plural resonant modes without a switch.

In accordance with one embodiment of the present disclosure, a wireless communication apparatus includes a substrate, an electrical insulation cover, a first antenna and a second antenna. The substrate has a ground surface. The electrical insulation cover covers the substrate. The electrical insulation cover has a first surface and a second surface opposite to each other. The first antenna is disposed on the first surface. The first antenna is electrically connected to the ground surface. The second antenna is disposed on the second surface. The second antenna includes a first capacitive coupling portion, a second capacitive coupling portion, a signal feeding portion and a first slit. The signal feeding portion connects the first capacitive coupling portion and the second capacitive coupling portion. The first slit is located between the first capacitive coupling portion and the second capacitive coupling portion. The first antenna is configured to generate a first resonant mode with the first capacitive coupling portion in a manner of capacitive coupling, and the first antenna is further configured to generate a second resonant mode with the second capacitive coupling portion in a manner of capacitive coupling. The first resonant mode and the second resonant mode have different frequency bands.

In accordance with another embodiment of the present disclosure, an antenna module includes an electrical insulation cover, a first antenna and a second antenna. The electrical insulation cover has a first surface and a second surface opposite to each other. The first antenna is disposed on the first surface. The second antenna is disposed on the second surface. The second antenna includes a first capacitive coupling portion, a second capacitive coupling portion, a signal feeding portion and a first slit. The signal feeding portion connects the first capacitive coupling portion and the second capacitive coupling portion. The first slit is located between the first capacitive coupling portion and the second capacitive coupling portion. The first antenna is configured to generate a first resonant mode with the first capacitive coupling portion in a manner of capacitive coupling, and the first antenna is further configured to generate a second resonant mode with the second capacitive coupling portion in a manner of capacitive coupling. The first resonant mode and the second resonant mode have different frequency bands.

In the foregoing embodiments, the first antenna and the second antenna are respectively disposed on two opposite surfaces of the electrical insulation cover, rather than the same surface. Therefore, sizes of the first antenna and the second antenna can be increased, so that the electrical lengths of the first antenna and the second antenna can be long enough such that the first resonant mode can cover the LTE 700 frequency band when the first antenna and the first capacitive coupling portion of the second antenna are capacitively coupled. Moreover, the first antenna and the second capacitive coupling portion of the second antenna can be further capacitively coupled to generate the second resonant mode different from the first resonant mode in frequency bands, which may benefit satisfying the LTE-CA requirements without employing a switch in the antenna module.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
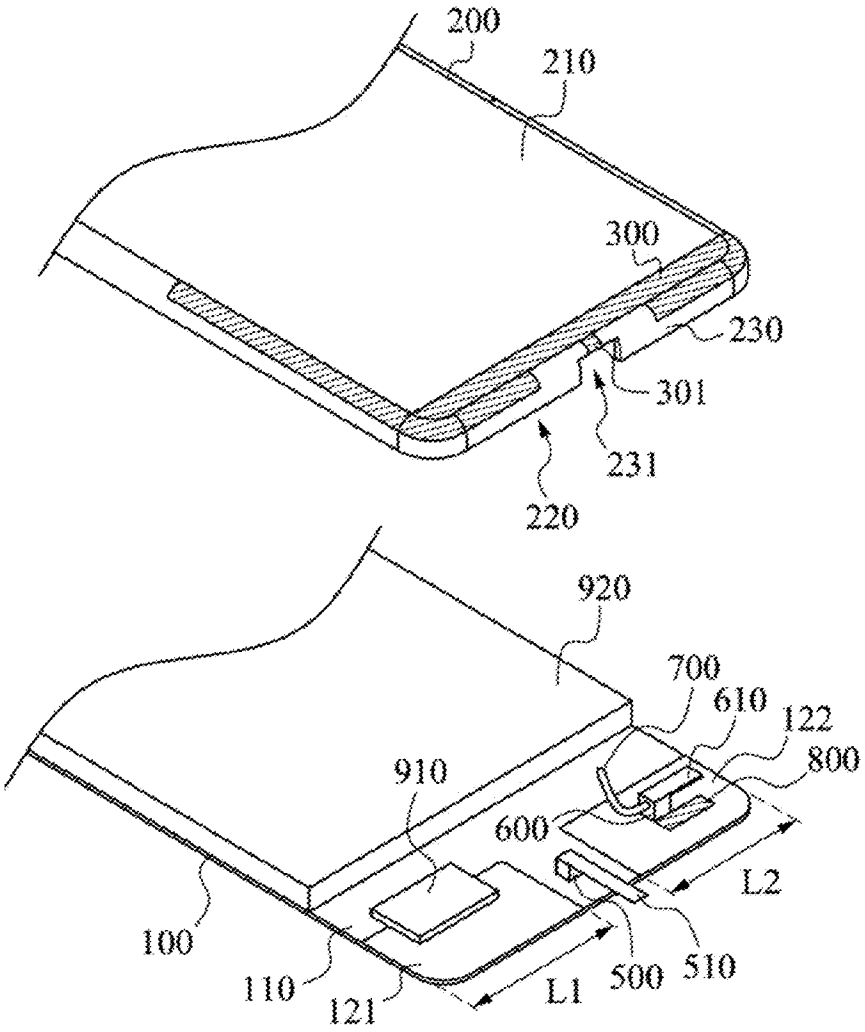
FIG. 1 is an explosive perspective schematic view of a wireless communication apparatus in accordance with one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

Figure 2:
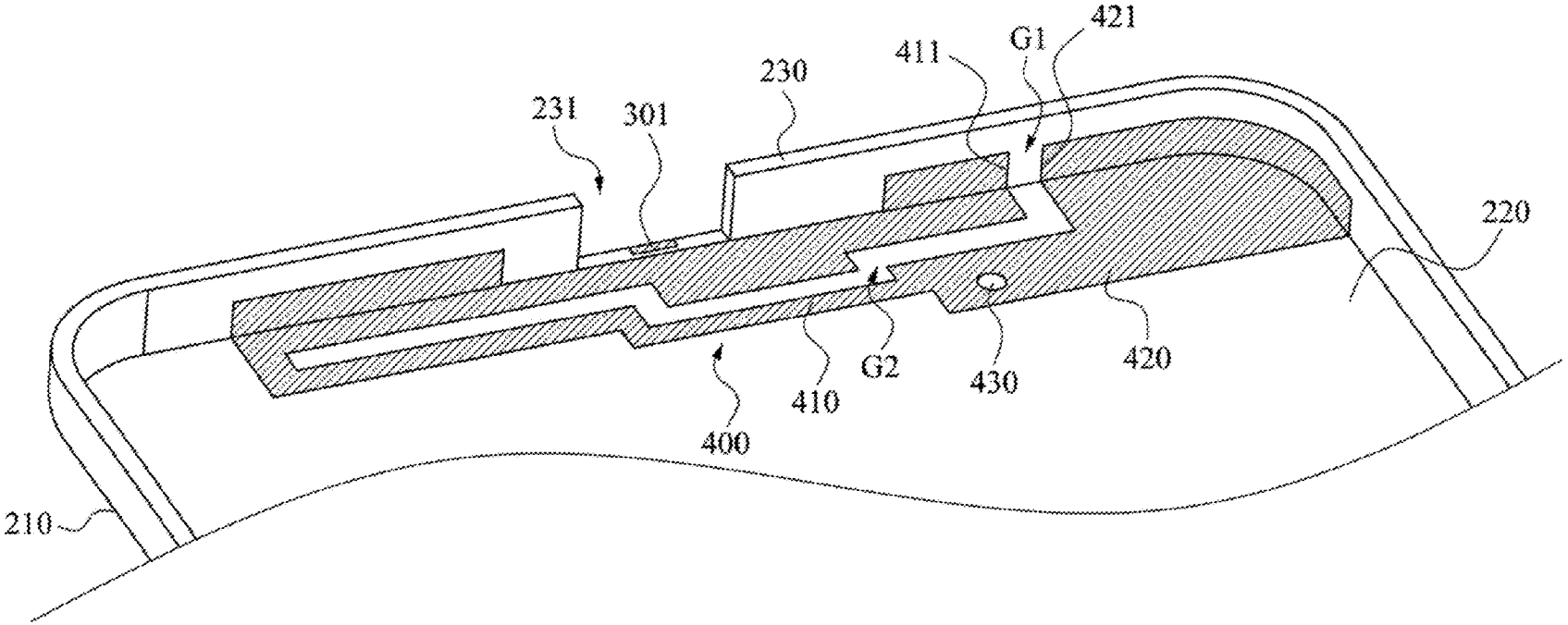
FIG. 2 is a schematic view of the antenna module shown in FIG. 1 from another view angle.

FIG. 1 is an explosive perspective schematic view of a wireless communication apparatus in accordance with one embodiment of the present disclosure. FIG. 2 is a schematic view of the antenna module shown in FIG. 1 from another view angle. As shown in FIGS. 1 and 2, in this embodiment, the wireless communication apparatus includes a substrate 100, an electrical insulation cover 200, a first antenna 300 and a second antenna 400. The substrate 100 has a ground surface 110. The first antenna 300 and the second antenna 400 are disposed on the electrical insulation cover 200. The electrical insulation cover 200, the first antenna 300 and the second antenna 400 cooperatively serve as an antenna module. The electrical insulation cover 200 covers the substrate 100. For example, the electrical insulation cover 200 can be an interior plastic cover within the wireless communication apparatus, and the substrate 100 can be a circuit board of the wireless communication apparatus covered by the plastic cover. The electrical insulation cover 200 has a first surface 210 and a second surface 220 opposite to each other. In other words, the first surface 210 and the second surface 220 respectively face toward counter directions. The first antenna 300 is disposed on the first surface 210. The first antenna 300 is electrically connected to the ground surface 110. The second antenna 400 is disposed on the second surface 220. In this embodiment, the first surface 210 is an outer surface distal to the substrate 100, and the second surface 220 is an inner surface proximal to the substrate 100.

As shown in FIG. 2, the second antenna 400 includes a first capacitive coupling portion 410, a second capacitive coupling portion 420, a signal feeding portion 430 and a first slit G1. The signal feeding portion 430 connects the first capacitive coupling portion 410 and the second capacitive coupling portion 420. The first capacitive coupling portion 410 has a first end 411. The first end 411 is located on a location of the first capacitive coupling portion 410, and the electrical length between this location and the signal feeding portion 430 is longest in the first capacitive coupling portion 410. The second capacitive coupling portion 420 has a second end 421. The second end 421 is located on a location of the second capacitive coupling portion 420, and the electrical length between the location and the signal feeding portion 430 is longest in the second capacitive coupling portion 420. The first slit G1 is located between the first capacitive coupling portion 410 and the second capacitive coupling portion 420 to separate the first end 411 of the first capacitive coupling portion 410 and the second end 421 of the second capacitive coupling portion 420.

When the antenna module transmits RF signals, the RF signals can be fed to the second antenna 400 via the signal feeding portion 430 and can be transmitted toward the first end 411 of the first capacitive coupling portion 410 and the second 421 of the second capacitive coupling portion 420, respectively. During this signals transmitted period, the first antenna 300 can generate a first resonant mode with the first capacitive portion 410 in a manner of capacitive coupling, and it can also generate a second resonant mode with the second capacitive coupling portion 420 in a manner of capacitive coupling. Since the first capacitive coupling portion 410 and the second capacitive coupling portion 420 are different in shape and size, they have different electrical lengths such that the first resonant mode and the second resonant mode have different frequency bands, which may implement a multi-frequency antenna to satisfy the LTE-CA requirements. It is understood that this paragraph employs RF signals transmitting method to explain operation of the antenna module. However, the RF signals receiving method is similar to the RF signals transmitting method, and therefore, it is not described repeatedly.

Since the first antenna 300 and the second antenna 400 are respectively disposed on the opposite first and second surfaces 210 and 220 of the electrical insulation cover 200, rather than the same surface. Therefore, sizes of the first antenna 300 and the second antenna 400 can be increased. As a result, when the first antenna 300 and the first capacitive coupling portion 410 of the second antenna 400 are capacitively coupled, the electrical lengths of the first antenna 300 and the second antenna 400 can be long enough such that the first resonant mode can cover the LTE 700 frequency band, so that the signal in LTE 700 frequency band can be transreceived without a switch, which may benefit satisfying the LTE-CA requirements.

The shorter the width of the first slit G1 is, the closer the first end 411 of the first capacitive coupling portion 410 and the second end 421 of the second capacitive coupling portion 420 are. Therefore, a shorter width of the first slit G1 is preferred for benefiting to increase the electrical length of the first capacitive coupling portion 410, thereby lowering the frequency band of the first resonant mode. For example, a preferred width of the first slit G1 is about 1 mm. By such a size, the first resonant mode generated by the first capacitive coupling portion 410 and the first antenna 300 can effectively cover the LTE 700 frequency band.

In some embodiments, as shown in FIGS. 1 and 2, an orthogonal projection of the first capacitive coupling portion 410 on the first surface 210 at least partially overlaps with the first antenna 300, so that the shortest distance therebetween is equal to a thickness of the electrical insulation cover 200, which may benefit the capacitive coupling of the first capacitive coupling portion 410 and the first antenna 300. Similarly, an orthogonal projection of the second capacitive coupling portion 420 on the first surface 210 at least partially overlaps with the first antenna 300, so that the shortest distance therebetween is equal to the thickness of the electrical insulation cover 200, which may benefit the capacitive coupling between the second capacitive coupling portion 420 and the first antenna 300. For example, a preferred width of the electrical insulation cover 200 is about 1 mm to reduce the shortest distance between the first antenna 300 and the first capacitive coupling portion 410 and the shortest distance between the first antenna 300 and the second capacitive coupling portion 420, so as to benefit the first antenna 300 to capacitively couple with the first capacitive coupling portion 410 and the second capacitive coupling portion 420.

In some embodiments, as shown in FIG. 1, the wireless communication apparatus further includes a connection port 500. The connection port 500 is disposed on the ground surface 110 of the substrate 100. In particular, an outer surface of the connection port 500 is in contact with the ground surface 110, and therefore, an electric potential of the outer surface of the connection port 500 is the same as that of the ground surface 110. As such, the first antenna 300 can be electrically connected to the ground surface 110 via the connection port 500, thereby implementing the grounding ability. In some embodiments, the connection port 500 can be, but is not limiting to, a USB connection port or a micro-USB connection port to electrically connect the wireless communication apparatus and other external electrical apparatuses.

In some embodiments, the wireless communication apparatus further includes a grounding contact spring 510. The grounding contact spring 510 is in contact with the connection port 500 and the first antenna 300, so as to electrically connect the connection port 500 and the first antenna 300. In particular, as shown in FIGS. 1 and 2, the first antenna 300 includes a ground portion 301, and the electrical insulation cover 200 includes a sidewall 230. An outer surface of the sidewall 230 connects the first surface 210, and an inner surface of the sidewall 230 connects the second surface 220. The ground portion 301 may extend from the first surface 210 to the sidewall 230. A fixed end of the grounding contact spring 510 is fixed to the connection port 500, and a free end of the grounding contact spring 510 is in contact with a portion of the ground portion 301 on the sidewall 230. As a result, the first antenna 300 can be electrically connected to the connection port 500 to implement the grounding ability. In some embodiments, the sidewall 230 has a recess 231. The recess 231 is disposed corresponding to the connection port 500 for exposing the connection port 500, so that the external electrical apparatus can be connected to the connection port 500. A portion of the ground portion 301 is located in the recess 231 for benefiting the electrical connection between the ground portion 301 and the connection port 500. More particularly, the ground portion 301 extends from the first surface 201 to the outer surface of the sidewall 230 and extends into the recess 231 to be in contact with the free end of the grounding contact spring 510.

In some embodiments, as shown in FIG. 1, the substrate 100 includes two clearance regions 121 and 122. The clearance region 121 is separated from and electrically insulated from the ground surface 110, and the clearance region 122 is separated from and electrically insulated from the ground surface 110 as well. For example, the ground surface 110 may be covered by metal, and the clearance regions 121 and 122 are both insulation surfaces without the metal covering the ground surface 110. The clearance regions 121 and 122 are respectively located on opposite sides of the connection port 500, such as left and right sides of the connection port 500. The clearance region 121 has a length L1. The clearance region 122 has a length L2. The difference between the lengths L1 and L2 is less than 1 mm. In other words, the clearance regions 121 and 122 have substantially equal length.

As a result, the connection port 500 can be substantially located on a central region of the substrate 100. Since the location of the connection port 500 corresponds to the ground portion 301, and the location of the first antenna 300 corresponds to the substrate 100, the ground portion 301 can be substantially located on the central region of the first antenna 300 and is not unduly close to the left side or right side of the first antenna 300. Therefore, the first antenna 300 can uniformly irradiate wireless signals via the left and right sides thereof, rather than irradiating wireless signals via almost only one side. As a result, such a design of the ground portion 301 that is located on the central region may reduce the band shift due to difference of the left-handed and right-handed transmission lines no matter which hand holds the wireless communication apparatus. Therefore, such a design may benefit both the left-hander and the right-hander to use the wireless communication apparatus.

For example, in some embodiments, the length L1 of the clearance region 121 may be 28 mm, and the length of the clearance region 122 may be 28.5 mm. For example, the clearance region 121 may be a rectangular region having a size of 28 mm×7 mm, and the clearance region 122 may also be a rectangular region having a size of 28.5 mm×8.5 mm. It is understood that the foregoing size is exemplary that can be modified depending on practical requirements.

In some embodiments, as shown in FIG. 1, the wireless communication apparatus further includes a signal feeding structure 600 and a signal transmission wire 700. The signal feeding structure 600 is disposed on the substrate 100 and is electrically insulated from the ground surface 110. In other words, the electric potential of the signal feeding structure 600 is not controlled by the electric potential of the ground surface 110. For example, the signal feeding structure 600 can be disposed on the clearance region 122, so that the signal feeding structure 600 can be electrically insulated from the ground surface 110. The signal feeding structure 600 is electrically connected to the signal feeding portion 430 of the second antenna 400 (See FIG. 2). A positive terminal of the signal transmission wire 700 is connected to the signal feeding structure 600. Therefore, the second antenna 400 can be electrically connected to the positive terminal of the signal transmission wire 700. A negative terminal of the signal transmission wire 700 is connected to the ground surface 110, so that the first antenna 300 can be electrically connected to the negative terminal of the signal transmission wire 700. In other words, the first antenna 300 and the second antenna 400 are respectively electrically connected to the negative terminal and the positive terminal of the signal transmission wire 700, so as to benefit the resonance generated by the first antenna 300 and the second antenna 400. In some embodiments, the signal transmission wire 700 can be, but is not limiting to, a coaxial transmission wire.

In some embodiments, as shown in FIGS. 1 and 2, the wireless communication apparatus further includes a feeding contact spring 610. The feeding contact spring 610 is in contact with the signal feeding structure 600 and the signal feeding portion 430 of the second antenna 400, so as to electrically connect the signal feeding structure 600 and the signal feeding portion 430. For example, a fixed end of the feeding contact spring 610 can be fixed to the signal feeding structure 600, and a free end of the feeding contact spring 610 can be in contact with the signal feeding portion 430 of the second antenna 400 when the electrical insulation cover 200 covers the substrate 100, so as to electrically connect the signal feeding structure 600 and the signal feeding portion 430.

In some embodiments, the wireless communication apparatus further includes a high frequency resonant structure 800. The high frequency resonant structure 800 is disposed on the substrate 100 and electrically insulated from the ground surface 110. In other words, the electric potential of the high frequency resonant structure 800 is not controlled by the electrical potential of the ground surface 110. For example, the high frequency resonant structure 800 is disposed on the clearance region 122. The high frequency resonant structure 800 is electrically connected to the signal feeding structure 600. In particular, the high frequency resonant structure 800 is in contact with the signal feeding structure 600, so that they can be electrically connected. An electrical length of the high frequency resonant structure 800 is less than an electrical length of the first capacitive coupling portion 410, and it is also less than an electrical length of the second capacitive coupling portion 420. Therefore, the high frequency resonant structure 800 can generate a resonant mode having a relative high frequency band to cover the high frequency band of LTE-CA.

Figure 3:
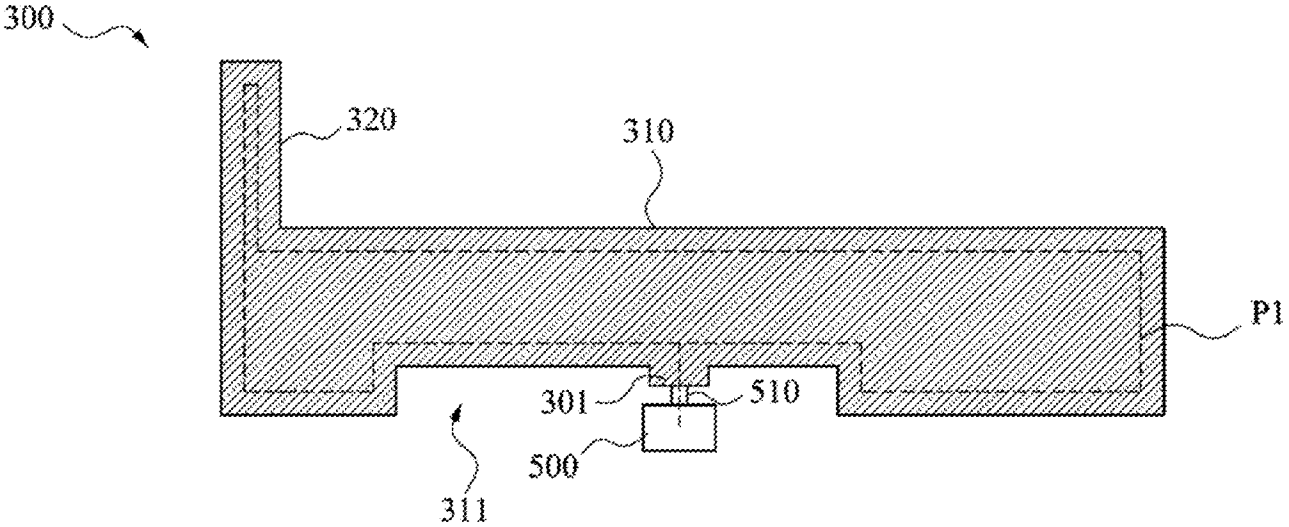
FIG. 3 is a schematic view illustrating an electrical path of the first antenna shown in FIG. 1.
Figure 4:
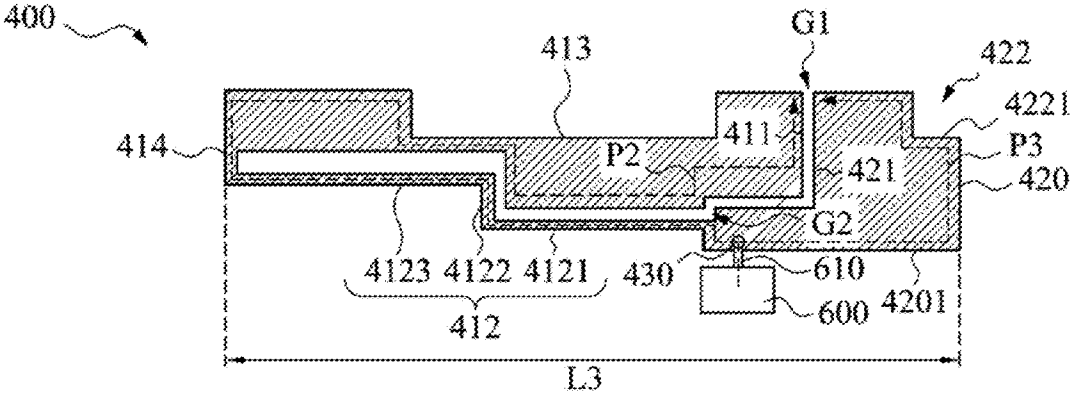
FIG. 4 is a schematic view illustrating an electrical path of the second antenna shown in FIG. 2.

FIG. 3 is a schematic view illustrating an electrical path of the first antenna 300 shown in FIG. 1. FIG. 4 is a schematic view illustrating an electrical path of the second antenna 400 shown in FIG. 2. As shown in FIGS. 3 and 4, the first antenna 300 and the connection port 500 cooperatively form an electrical path P1. The first capacitive coupling portion 410 of the second antenna 400 and the signal feeding structure 600 cooperatively form an electrical path P2. The second capacitive coupling portion 420 of the second antenna 400 and the signal feeding structure 600 cooperatively form an electrical path P3. In particular, the electrical path P2 includes an electrical path from the signal feeding structure 600 to the signal feeding portion 430, and an electrical path from the signal feeding portion 430 to the first end 411. The electrical path P3 includes an electrical path from the signal feeding structure 600 to the signal feeding portion 430, and an electrical path from the signal feeding portion 430 to the second end 421.

Figure 5:
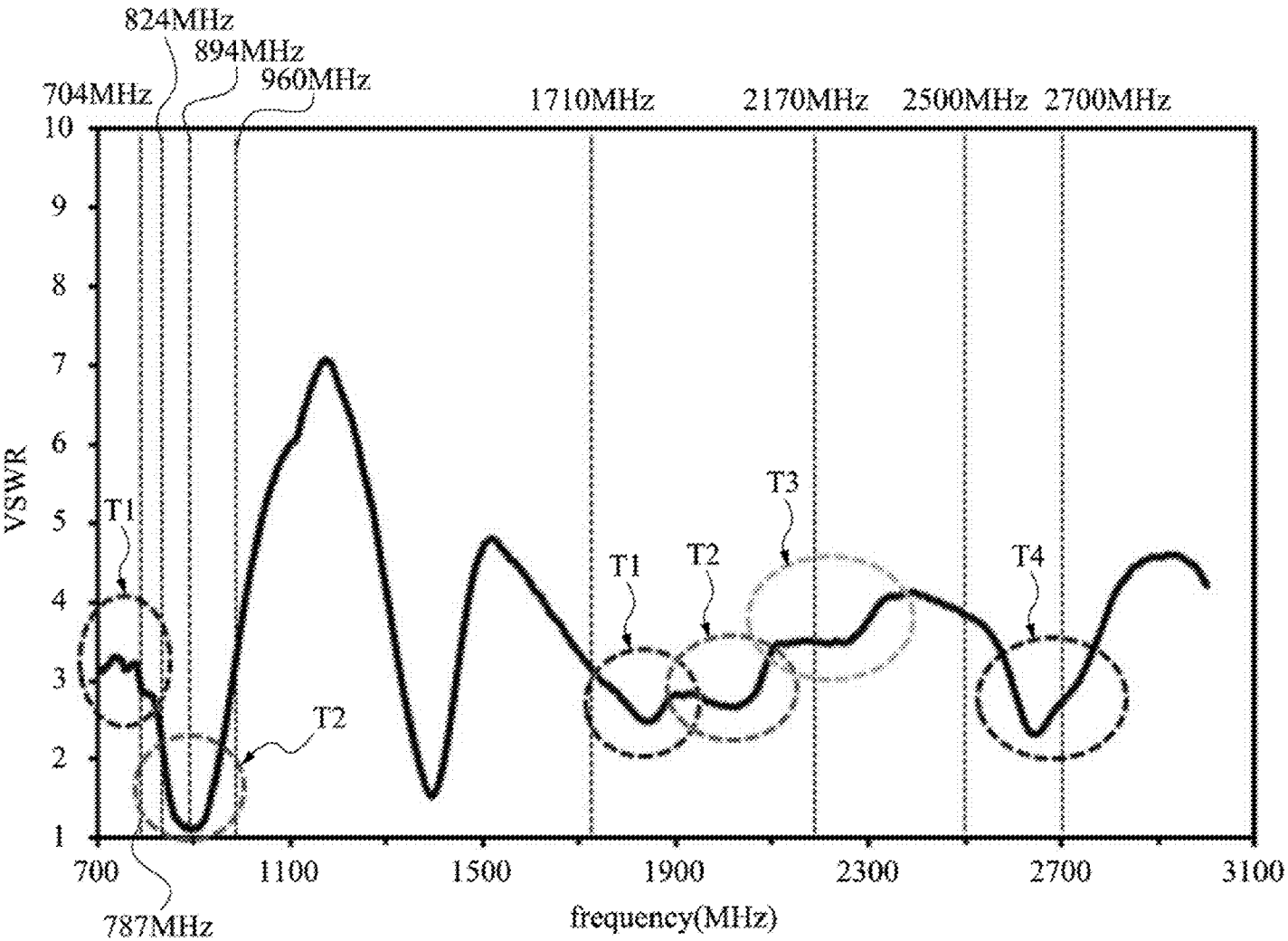
FIG. 5 is a graph of voltage standing-wave ratio (VSWR) versus frequency of the wireless communication apparatus shown in FIG. 1

FIG. 5 is a graph of voltage standing-wave ratio (VSWR) versus frequency of the wireless communication apparatus shown in FIG. 1. As shown in FIG. 5, the electrical path P2 of the first capacitive coupling portion 410 and the electrical path P1 of the first antenna 300 are capacitively coupled to generate the first resonant mode T1. The baseband of the first resonant mode T1 covers 700 MHz, and the double frequency band of the baseband covers 1700 MHz to 1900 MHz. Furthermore, the electrical path P2 of the first capacitive coupling portion 410 resonates itself, and the resonant frequency is about 700 MHz, so as to transreceive the signal in the LTE 700 frequency band.

The electrical path P3 of the second capacitive coupling portion 420 and the electrical path P1 of the first antenna 300 are capacitively coupled to generate the second resonant mode T2. The baseband of the second resonant mode T2 covers 800 MHz to 960 MHz, and the double frequency band of the second resonant mode T2 covers 1900 MHz to 2100 MHz.

The electrical path P3 of the second capacitive coupling portion 420 can generate a third resonant mode T3 itself, and the third resonant mode T3 covers 2100 MHz to 2300 MHz. The electrical path formed by the signal feeding structure 600 and the high frequency resonant structure 800 can generate a fourth resonant mode T4 that covers 2500 MHz to 2800 MHz.

As shown in FIG. 5, the wireless communication apparatus according to this embodiment can transreceive signals in frequency bands of LTE 700, GSM 850, EGSM 900, DSC 1800, PCS 1900, UMTS 2100, LTE 2500, thereby effectively satisfying the LTE-CA requirements.

In order to lower the frequency band of the first resonant mode T1 for transreceiving signals of LTE 700, in some embodiments, the first capacitive coupling portion 410 includes a first electrical conductive sheet 412, a second electrical conductive sheet 413, a connection electrical conductive sheet 414 and a second slit G2. One end of the first electrical conductive sheet 412 is connected to the signal feeding portion 430. Another end of the first electrical conductive sheet 412 and the second electrical conductive sheet 413 extend from the same side of the connection electrical conductive sheet 414. The second slit G2 is located between the first electrical conductive sheet 412 and the second electrical conductive sheet 413. Therefore, the electrical path P2 of the first capacitive coupling portion 410 is similar to a U-shaped path, which may effectively increase the electrical length of the first capacitive coupling portion 410 and lower the frequency band of the first resonant mode T1, so as to benefit the baseband of the first resonant mode T1 to cover 700 MHz for transreceiving the signal of LTE 700.

In some embodiments, as shown in FIG. 4, the first slit G1 communicates with the second slit G2. In other words, the first slit G1 and the second slit G2 are formed integrally as one slit. Therefore, the first slit G1 and the second slit G2 can be formed as long as one groove, such as an L-shaped groove, is formed on the second antenna 400, so as to reduce the cost of respectively forming two slits on the second antenna 400.

In some embodiments, as shown in FIG. 4, the first electrical conductive sheet 412 includes a first sheet body 4121, a second sheet body 4122 and a third sheet body 4123. The first sheet body 4121 leftwardly extends from the signal feeding portion 430. The second sheet body 4122 upwardly extends from an end of the first sheet body 4121. The third sheet body 4123 leftwardly extends from an end of the second sheet body 4122. The connection electrical conductive sheet 414 upwardly extends from an end of the third sheet body 4123. The second electrical conductive sheet 413 rightwardly extends from the connection electrical conductive sheet 414. The second shit G2 formed by such a foregoing structure may enable the baseband of the first resonant mode T1 to cover 700 MHz.

In some embodiments, as shown in FIG. 4, the second capacitive coupling portion 420 has a recess 422. The recess 422 is distal to the first slit G1. A preferred two-dimensional size of the recess 422 is 4 mm×4 mm. A preferred distance from a bottom 4221 of the recess 422 to a bottom 4201 of the second capacitive coupling portion 420 is 10 mm. A length L3 of the second antenna 400 (namely, the longest transversal distance from the first capacitive coupling portion 410 to the second capacitive coupling portion 420) is 65 mm. The second antenna 400 having such a foregoing size may benefit to generate the first resonant mode T1, the second resonant mode T2 and the third resonant mode T3 as shown in FIG. 5.

In some embodiments, as shown in FIG. 3, the first antenna 300 includes a main electrical conductive sheet 310 and an auxiliary electrical conductive sheet 320. The auxiliary electrical conductive sheet 320 protrudes from one side of the maim electrical conductive sheet 310. Another side of the main electrical conductive sheet has a recess 311. The size of the auxiliary electrical conductive sheet 320 and the size of the recess 311 may be used to adjust the impedance-matching bandwidth such that the baseband of the second resonant mode T2 covers 800 MHz to 960 MHz. Further, the size of the auxiliary electrical conductive sheet 320 and the size of the recess 310 can also be used to improve the impedance match in the range of 700 MHz to 800 MHz. For example, the two-dimensional size of the auxiliary electrical conductive sheet 320 can be 18 mm×7 mm, and the two-dimensional size of the recess can be 38 mm×5 mm. By such a foregoing size, the baseband of the second resonant mode T2 can cover 800 MHz to 960 MHz, and the impedance match in the range of 700 MHz to 800 MHz can be improved as well.

Two following tables respectively show the antenna efficiency and antenna gain in the low frequency band and the high frequency band.

TABLE 1 antenna efficiency and antenna gain in low frequency band

| frequency (MHz) | efficiency (%) | gain (dB) |
|---|---|---|
| 704 | 14.4 | −8.4 |
| 710 | 17.1 | −7.7 |
| 716 | 19.1 | −7.2 |
| 734 | 22.3 | −6.5 |
| 740 | 23.1 | −6.4 |
| 746 | 24.4 | −6.1 |
| 756 | 24.4 | −6.1 |

TABLE 1-continued antenna efficiency and antenna gain in low frequency band

| frequency (MHz) | efficiency (%) | gain (dB) |
|---|---|---|
| 765 | 26.0 | −5.8 |
| 772 | 27.4 | −5.6 |
| 777 | 32.5 | −4.9 |
| 782 | 33.1 | −4.8 |
| 787 | 33.8 | −4.7 |
| 791 | 34.6 | −4.6 |
| 806 | 34.2 | −4.7 |
| 821 | 35.8 | −4.5 |
| 824 | 36.0 | −4.4 |
| 836 | 36.3 | −4.4 |
| 849 | 37.9 | −4.2 |
| 862 | 40.6 | −3.9 |
| 869 | 41.0 | −3.9 |
| 880 | 40.5 | −3.9 |
| 894 | 38.7 | −4.1 |
| 900 | 36.4 | −4.4 |
| 915 | 33.5 | −4.7 |
| 925 | 30.9 | −5.1 |
| 940 | 28.1 | −5.5 |
| 960 | 24.9 | −6.0 |

TABLE 2 antenna efficiency and antenna gain in high frequency band

| frequency (MHz) | efficiency (%) | gain (dB) |
|---|---|---|
| 1710 | 35.8 | −4.5 |
| 1730 | 39.6 | −4.0 |
| 1750 | 40.6 | −3.9 |
| 1770 | 40.0 | −4.0 |
| 1785 | 39.5 | −4.0 |
| 1805 | 39.2 | −4.1 |
| 1840 | 39.2 | −4.1 |
| 1850 | 38.0 | −4.2 |
| 1880 | 35.7 | −4.5 |
| 1910 | 46.8 | −3.3 |
| 1920 | 50.3 | −3.0 |
| 1930 | 52.5 | −2.8 |
| 1950 | 52.8 | −2.8 |
| 1960 | 53.4 | −2.7 |
| 1980 | 52.8 | −2.8 |
| 1995 | 52.1 | −2.8 |
| 2110 | 43.6 | −3.6 |
| 2140 | 44.5 | −3.5 |
| 2170 | 43.3 | −3.6 |
| 2300 | 34.9 | −4.6 |
| 2325 | 34.1 | −4.7 |
| 2350 | 36.7 | −4.3 |
| 2375 | 35.4 | −4.5 |
| 2400 | 33.0 | −4.8 |
| 2500 | 21.9 | −6.6 |
| 2515 | 19.7 | −7.1 |
| 2535 | 20.4 | −6.9 |
| 2555 | 21.7 | −6.6 |
| 2570 | 21.9 | −6.6 |
| 2595 | 25.2 | −6.0 |
| 2620 | 24.4 | −6.1 |
| 2630 | 23.7 | −6.3 |
| 2655 | 23.0 | −6.4 |
| 2680 | 22.2 | −6.5 |
| 2690 | 22.7 | −6.4 |

As shown in Table 1, the antenna frequency in the low frequency band (704 MHz to 960 MHz) ranges from 14.4% to 41%, and the antenna frequency in the high frequency band (1710 MHz to 2690 MHz) ranges from 20.4% to 53.4%. Therefore, the antenna module of the foregoing wireless communication apparatus can effectively satisfy band requirements of LTE-CA.

Reference is made to FIG. 1. In some embodiments, the wireless communication apparatus further includes a speaker 910 and a battery 920. The speaker 910 is located across the ground surface 110 and the clearance region 121. In other words, the speaker 910 is partially located on the ground surface 110 and partially located on the clearance region 121. The battery 920 is located on the ground surface 110. The speaker 910 and the battery 920 are separated by an interval, and this interval is about 6 mm.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A wireless communication apparatus, comprising:

a substrate having a ground surface;

an electrical insulation cover covering the substrate, the electrical insulation cover having a first surface and a second surface opposite to each other;

a first antenna disposed on the first surface and electrically connected to the ground surface; and a second antenna disposed on the second surface, the second antenna comprising a first capacitive coupling portion, a second capacitive coupling portion, a signal feeding portion and a first slit, wherein the signal feeding portion connects the first capacitive coupling portion and the second capacitive coupling portion, and the first slit is located between the first capacitive coupling portion and the second capacitive coupling portion, wherein the first antenna is configured to generate a first resonant mode with the first capacitive coupling portion in a manner of capacitive coupling, and the first antenna is further configured to generate a second resonant mode with the second capacitive coupling portion in a manner of capacitive coupling, wherein the first resonant mode and the second resonant mode have different frequency bands.

2. The wireless communication apparatus of claim 1, further comprising a connection port disposed on the ground surface of the substrate and electrically connected to the first antenna.

3. The wireless communication apparatus of claim 2, wherein the substrate comprises two clearance regions, wherein the clearance regions are separated from and electrically insulated from the ground surface, and the clearance regions are respectively located on opposite sides of the connection port, and a difference between lengths of the clearance regions is less than 1 mm.

4. The wireless communication apparatus of claim 2, further comprising a grounding contact spring in contact with the connection port and the first antenna.

5. The wireless communication apparatus of claim 1, further comprising a signal feeding structure disposed on the substrate and electrically insulated from the ground surface, wherein the signal feeding structure is electrically connected to the signal feeding portion of the second antenna.

6. The wireless communication apparatus of claim 5, further comprising a feeding contact spring in contact with the signal feeding structure and the signal feeding portion.

7. The wireless communication apparatus of claim 5, further comprising a high frequency resonant structure disposed on the substrate and electrically insulated from the ground surface, wherein the high frequency resonant structure is electrically connected to the signal feeding structure, and an electrical length of the high frequency resonant structure is less than an electrical length of the first capacitive coupling portion and an electrical length of the second capacitive coupling portion.

8. The wireless communication apparatus of claim 1, wherein the wherein the first capacitive coupling portion comprises a first electrical conductive sheet, a second electrical conductive sheet, a connection electrical conductive sheet and a second slit, wherein one end of the first electrical conductive sheet is connected to the signal feeding portion, wherein another end of the first electrical conductive sheet and the second electrical conductive sheet extend from the same side of the connection electrical conductive sheet, and wherein the second slit is located between the first electrical conductive sheet and the second electrical conductive sheet.

9. The wireless communication apparatus of claim 8, wherein the first slit communicates with the second slit.

10. The wireless communication apparatus of claim 1, wherein the first antennal comprises a main electrical conductive sheet and an auxiliary electrical conductive sheet protruding from one side of the main electrical conductive sheet, and another side of the main electrical conductive sheet has a recess.

11. An antenna module, comprising:

an electrical insulation cover having a first surface and a second surface opposite to each other;

a first antenna disposed on the first surface; and a second antenna disposed on the second surface, the second antenna comprising a first capacitive coupling portion, a second capacitive coupling portion, a signal feeding portion and a first slit, wherein the signal feeding portion connects the first capacitive coupling portion and the second capacitive coupling portion, and the first slit is located between the first capacitive coupling portion and the second capacitive coupling portion, wherein the first antenna is configured to generate a first resonant mode with the first capacitive coupling portion in a manner of capacitive coupling, and the first antenna is further configured to generate a second resonant mode with the second capacitive coupling portion in a manner of capacitive coupling, wherein the first resonant mode and the second resonant mode have different frequency bands.

12. The antenna module of claim 11, wherein the first capacitive coupling portion comprises a first electrical conductive sheet, a second electrical conductive sheet, a connection electrical sheet and a second slit, wherein one end of the first electrical conductive sheet is connected to the signal feeding portion, wherein another end of the first electrical conductive sheet and the second electrical conductive sheet extend from the same side of the connection electrical conductive sheet, and wherein the second slit is located between the first electrical conductive sheet and the second electrical conductive sheet.

13. The antenna module of claim 12, wherein the first slit communicates with the second slit.

14. The antenna module of claim 11, wherein the first antenna comprises a main electrical conductive sheet and an auxiliary electrical conductive sheet protruding from one side of the main electrical conductive sheet, and another side of the main electrical conductive sheet has a recess.

* * * * *